US011673237B2

(12) United States Patent
Hsieh

(10) Patent No.: US 11,673,237 B2
(45) Date of Patent: Jun. 13, 2023

(54) WRENCH STRUCTURE WITH VARIABLE DRIVING STATE

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 240 days.

(21) Appl. No.: 17/304,997

(22) Filed: Jun. 29, 2021

(65) Prior Publication Data

US 2022/0097213 A1 Mar. 31, 2022

(30) Foreign Application Priority Data

Sep. 30, 2020 (TW) ..... 109134257

(51) Int. Cl.
*B25B 13/46* (2006.01)

(52) U.S. Cl.
CPC ..... *B25B 13/468* (2013.01); *B25B 13/466* (2013.01)

(58) Field of Classification Search
CPC ..... B25B 13/44; B25B 13/46; B25B 13/461; B25B 13/463; B25B 13/465; B25B 13/466; B25B 13/468; B25B 13/48; B25B 23/00; B25B 23/0028
See application file for complete search history.

(56) References Cited

U.S. PATENT DOCUMENTS 4,406,183 A * 9/1983 Wix ..... B25B 13/463 192/96
2008/0041193 A1* 2/2008 Baker ..... B25B 13/06 81/124.6
2018/0272506 A1* 9/2018 Jiang ..... B25B 13/06

* cited by examiner

*Primary Examiner* — Robert J Scruggs
(74) *Attorney, Agent, or Firm* — Wang Law Firm, Inc.

(57) ABSTRACT

A wrench structure with a variable driving state includes a rod and a sleeve connected to the rod. An outer surface of the rod includes an accommodating slot, an engaging block, an elastic element, and a connecting portion. The engaging block and the elastic element are disposed in the accommodating slot. The connecting portion is adjacent to the accommodating slot and surrounds the outer surface of the rod. The sleeve includes a first ratchet portion, a second ratchet portion, and a non-ratchet portion located between the two ratchet portions. The sleeve can be selectively displaced relative to the rod to a first position, where the connecting portion is connected with the second ratchet portion, or a second position, where the connecting portion is adjacent to the non-ratchet portion. By controlling the relative positions of the rod and the sleeve, the driving state of the wrench structure can be switched.

9 Claims, 8 Drawing Sheets

WRENCH STRUCTURE WITH VARIABLE DRIVING STATE

BACKGROUND OF THE INVENTION

1. Technical Field

The present invention relates to a wrench structure with a variable driving state. More particularly, the invention relates to a wrench structure that has a variable driving state and allows its driving state to be switched.

2. Description of Related Art

Currently, wrenches on the market can be divided into two major types: those with a ratcheting socket and those with a fixed head. A fixed-head wrench (e.g., a fixed-socket wrench) can advantageously output a relatively high torque but is rather inconvenient in terms of its locking and unlocking operations. A ratchet wrench features switchable one-way rotation to facilitate locking and unlocking but outputs a lower torque than a fixed-head wrench. A wrench user, therefore, must have both, if not more, types of wrenches at hand in order to meet operational requirements.

In view of the above, it is a worthwhile research and development goal in the related industries to develop a wrench structure whose driving state can be changed in order to provide the advantages of both a fixed-head wrench and a ratchet wrench.

BRIEF SUMMARY OF THE INVENTION

According to an embodiment of the present invention, a wrench structure with a variable driving state includes a rod and a sleeve. The sleeve is connected to the rod and can be selectively displaced to a first position or a second position relative to the rod. The rod has an outer surface that includes an accommodating slot, an engaging block, at least one elastic element, and a connecting portion. The engaging block is disposed in the accommodating slot, has a surface portion formed as a curved surface, and includes a plurality of ratchet teeth. The ratchet teeth are disposed on the curved surface of the engaging block. The elastic element is disposed in the accommodating slot, presses against a wall portion of the accommodating slot at one end, and presses against the engaging block at the opposite end. The connecting portion is adjacent to the accommodating slot and surrounds the outer surface of the rod. The inner surface of the sleeve includes a first ratchet portion, a second ratchet portion, and a non-ratchet portion. The non-ratchet portion is located between the first ratchet portion and the second ratchet portion. When the sleeve is at the first position, the connecting portion is connected with the second ratchet portion; when the sleeve is at the second position, the connecting portion is adjacent to the non-ratchet portion.

The wrench structure with a variable driving state is preferably so configured that the axial length of the engaging block is greater than the axial length of the connecting portion.

The wrench structure with a variable driving state is preferably so configured that the engaging block includes two protruding posts. The two protruding posts are disposed at two ends of the engaging block respectively and abut against two other wall portions of the accommodating slot respectively.

The wrench structure with a variable driving state is preferably so configured that the rod further includes an enclosing portion. The enclosing portion is connected to the accommodating slot and renders the cross section of the accommodating slot into a square U shape.

The wrench structure with a variable driving state is preferably so configured that the engaging block has a fan-shaped cross section.

The wrench structure with a variable driving state preferably further includes at least one installation groove. The installation groove is formed in at least one of an inner surface of the rod and another surface portion of the engaging block so that the elastic element can be installed in the installation groove.

The wrench structure with a variable driving state is preferably so configured that the rod further includes a first identification groove and a second identification groove. The first identification groove is disposed in the outer surface of the rod. The second identification groove is also disposed in the outer surface of the rod and is located farther away from the connecting portion than is the first identification groove.

The wrench structure with a variable driving state is preferably so configured that the sleeve further includes at least two annular recesses disposed in the inner surface of the sleeve, and that the rod further includes a receiving groove, a positioning ball, and a spring. The receiving groove is formed in the outer surface of the rod. The positioning ball is received in the receiving groove. The spring is also received in the receiving groove and presses against the positioning ball at one end such that the positioning ball juts out from the outer surface of the rod in a retractable manner. The positioning ball can be selectively connected with either one of the annular recesses.

The wrench structure with a variable driving state preferably further includes a C-shaped retaining ring and an interference fit member. The C-shaped retaining ring is disposed on the outer surface of the rod to connect the sleeve to the rod. The interference fit member is disposed on the inner surface of the sleeve, protrudes from the inner surface of the sleeve, and presses against the outer surface of the rod.

The foregoing structural arrangements allow the relative positions of the rod and the sleeve to be controlled in order to connect the connecting portion to the second ratchet portion or the non-ratchet portion selectively, thereby switching the driving state of the wrench structure with a variable driving state, making it easier to use the wrench structure with a variable driving state.

BRIEF DESCRIPTION OF THE SEVERAL VIEWS OF THE DRAWINGS

The above and other objectives as well as the features and advantages of the present invention can be better understood by referring to the following detailed description of some illustrative embodiments of the invention in conjunction with the accompanying drawings, in which.

DETAILED DESCRIPTION OF THE INVENTION

Figure 1:
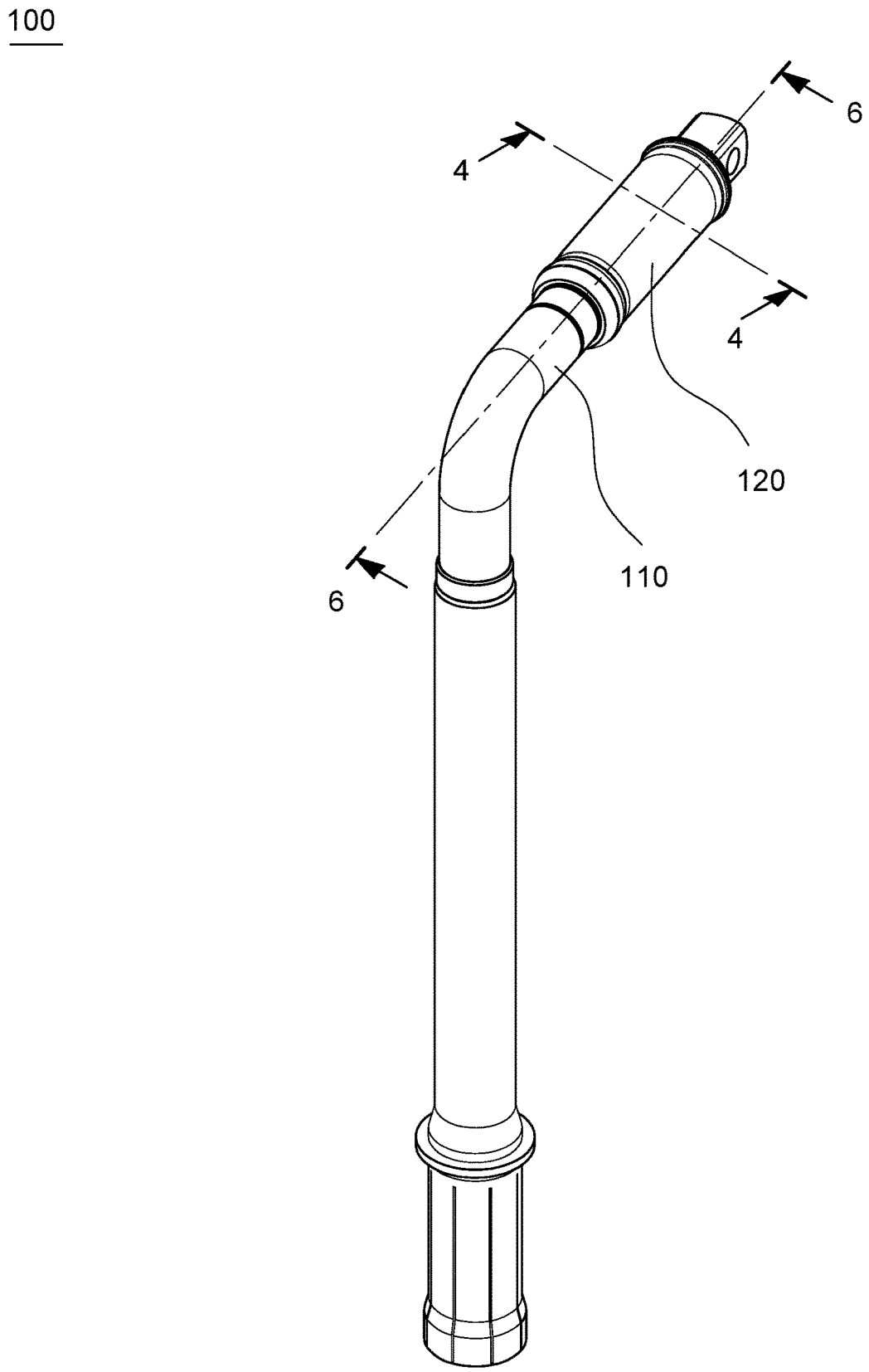
FIG. 1 is a perspective view of the wrench structure with a variable driving state according to an embodiment of the invention.

A number of embodiments of the present invention are described below with reference to the drawings. In order for the following description to be clear and definite, many practical details are included in the description. It should be understood, however, that those practical details are not intended to limit the invention. That is to say, the practical details are not essential to some embodiments of the invention. In addition, some conventional structures and elements are shown only schematically in the drawings for the sake of simplicity, and repeated elements may be indicated by the same reference numeral.

Figure 6:
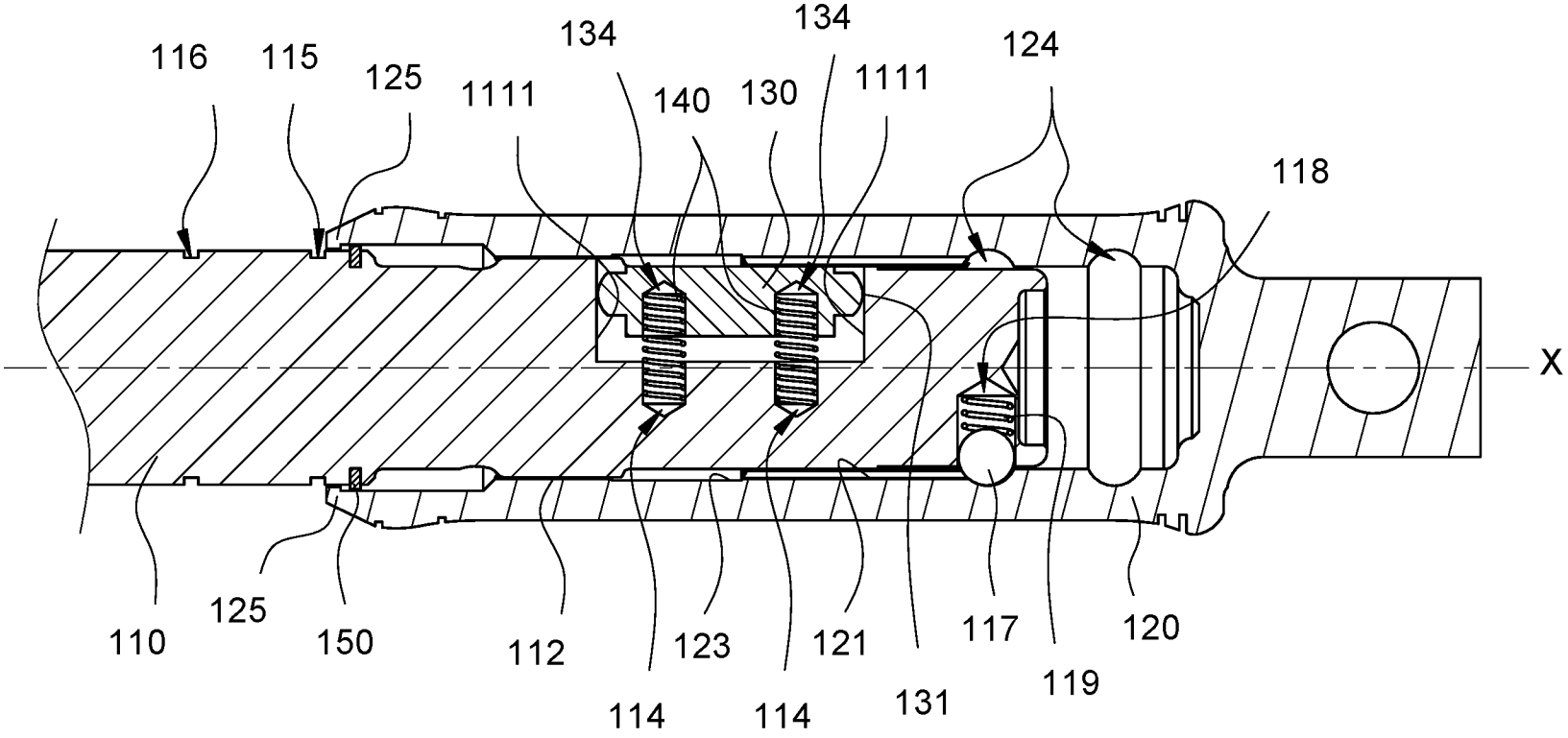
FIG. 6 is a sectional view, taken along line 6-6 in FIG. 1, of the wrench structure with a variable driving state according to the embodiment in FIG. 1.
Figure 7:
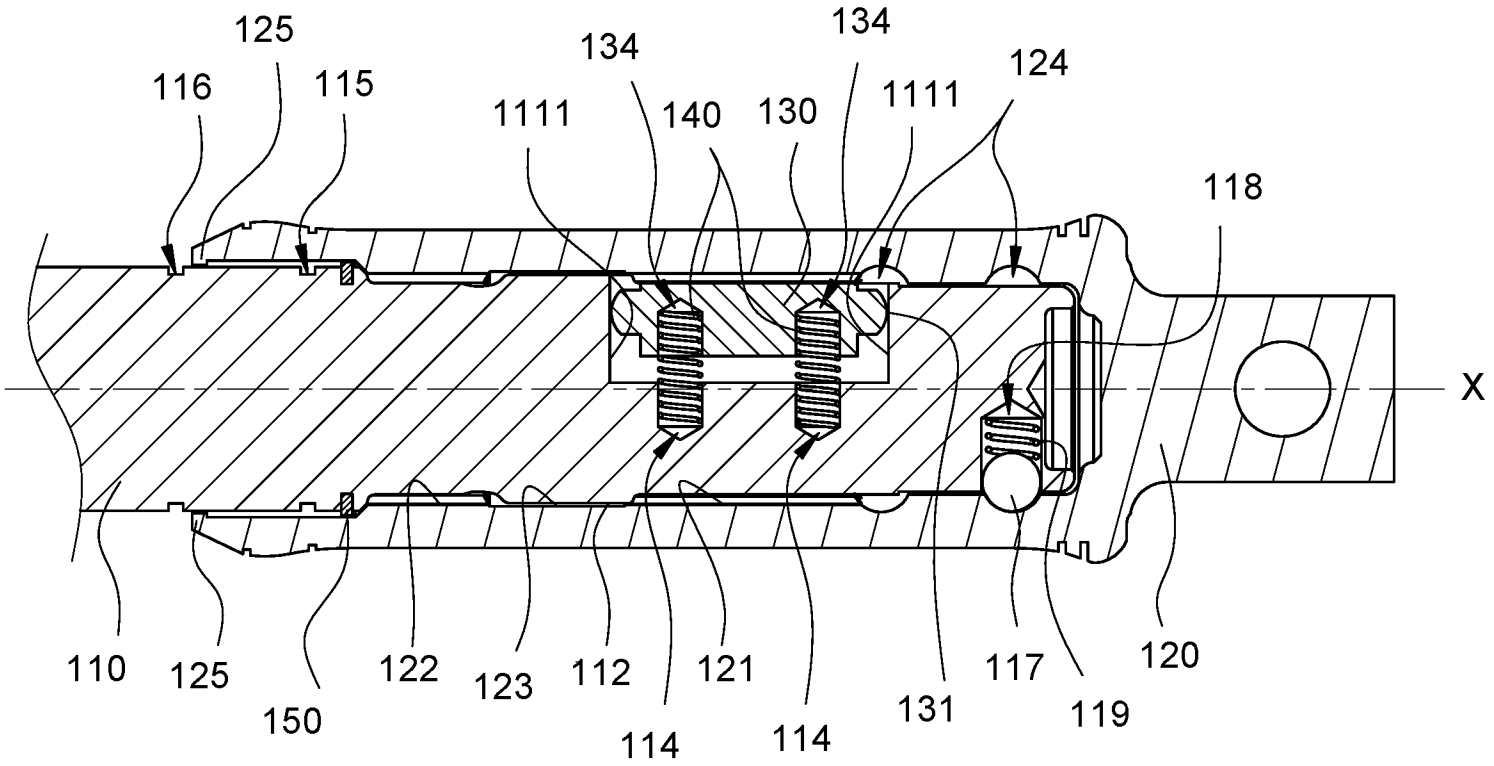
FIG. 7 is another sectional view, taken along line 6-6 in FIG. 1, of the wrench structure with a variable driving state according to the embodiment in FIG. 1.

Please refer to FIG. 1 for a perspective view of the wrench structure 100 with a variable driving state according to an embodiment of the present invention. The wrench structure 100 with a variable driving state is configured to connect to a to-be-locked object (not shown). In FIG. 1, the wrench structure 100 with a variable driving state is an angled socket wrench, but the invention is not limited to this type of wrenches. As shown in FIG. 1, the wrench structure 100 with a variable driving state includes a rod 110 and a sleeve 120. The sleeve 120 is connected to the rod 110. The sleeve 120 can be selectively displaced to a first position (as shown in FIG. 6) or a second position (as shown in FIG. 7) relative to the rod 110. Thus, by changing the relative positions of the sleeve 120 and the rod 110, the wrench structure 100 with a variable driving state can be brought into different driving states, or more specifically can be switched between a fixed-head wrench and a ratchet wrench, allowing its user to perform locking and unlocking operations with greater ease.

Figure 2:
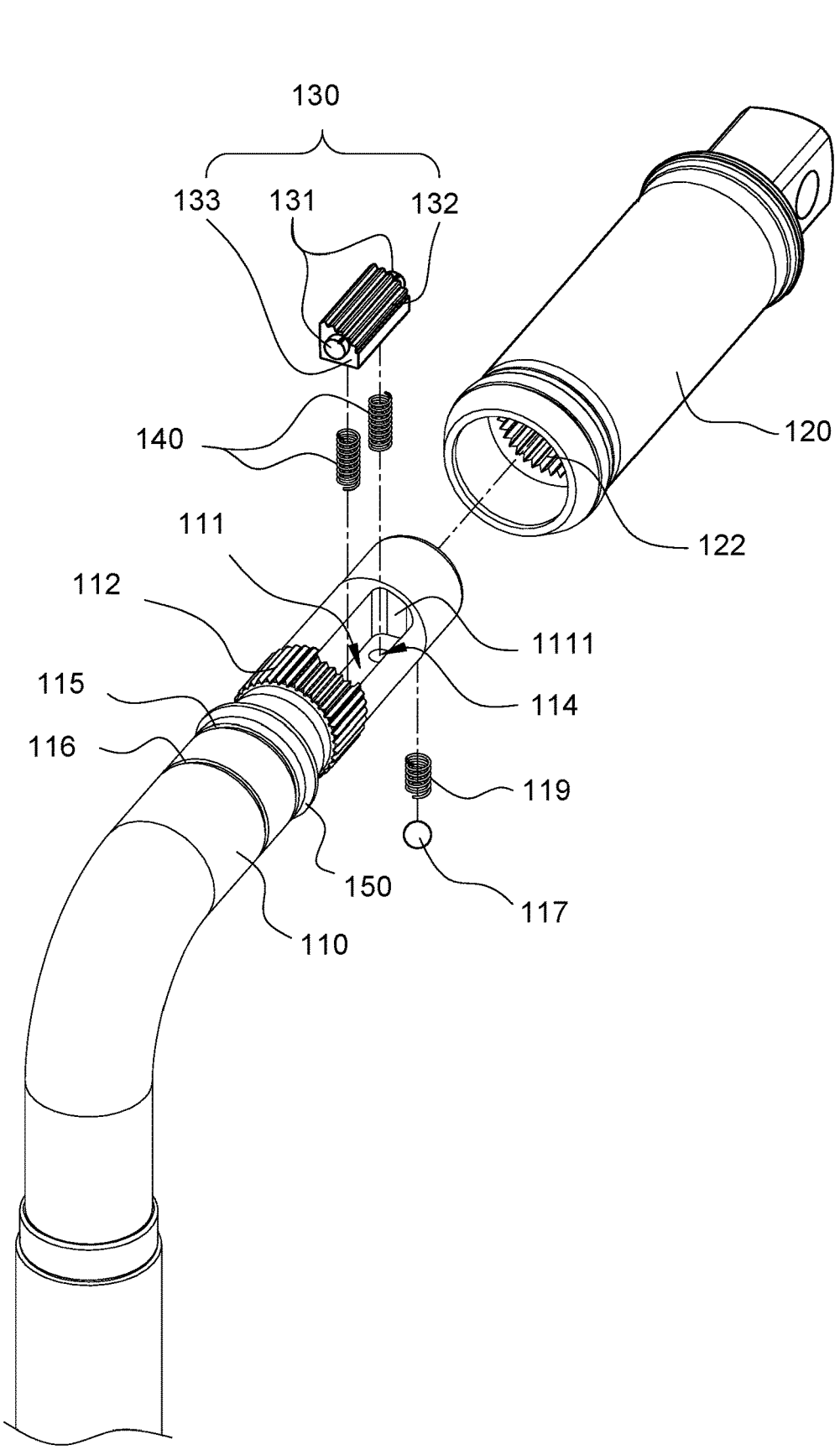
FIG. 2 is a partial exploded view of the wrench structure with a variable driving state according to the embodiment in FIG. 1.
Figure 3:
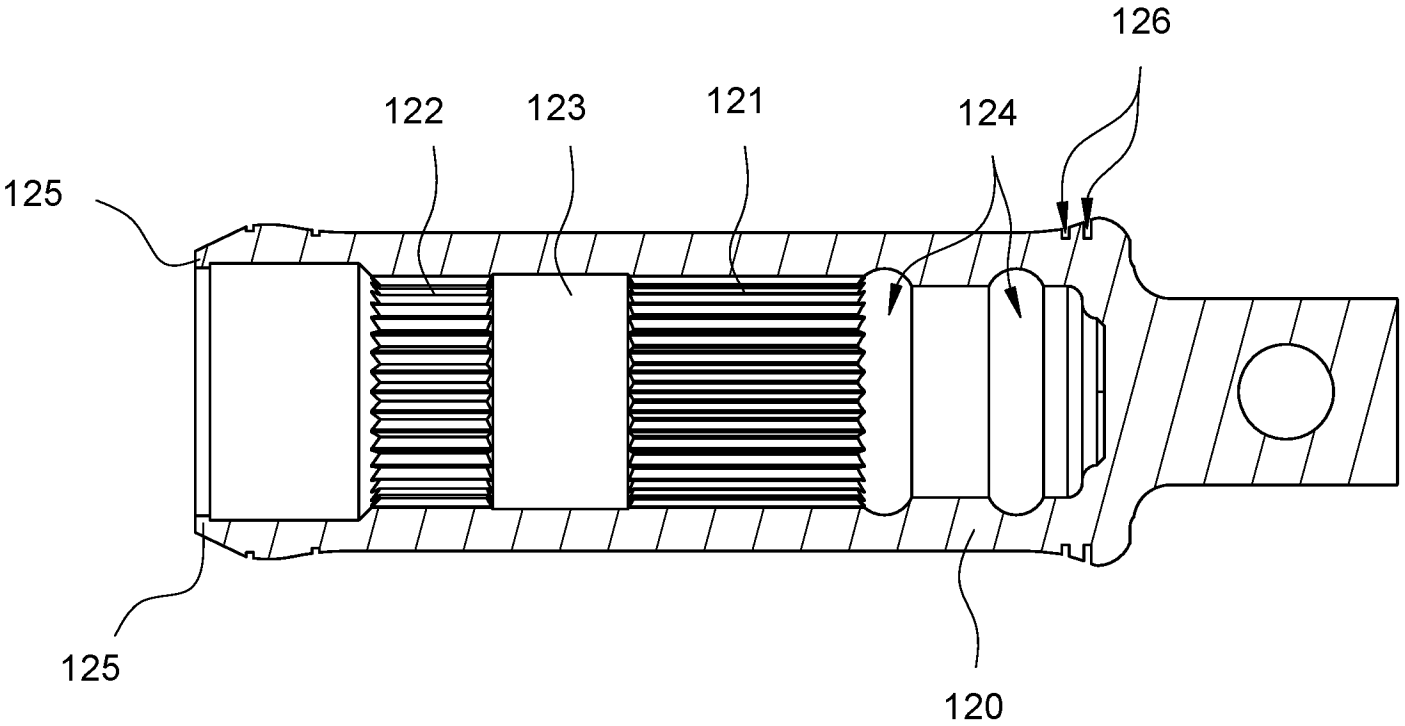
FIG. 3 is a sectional view of the sleeve in the embodiment in FIG. 1.

Please refer to FIG. 2 and FIG. 3 respectively for a partial exploded view of the wrench structure 100 with a variable driving state according to the embodiment in FIG. 1 and a sectional view of the sleeve 120 in the embodiment in FIG. 1. Both the sleeve 120 and the rod 110 in FIG. 1 have a circular cross section. The sleeve 120 has an accommodating space (not denoted by a reference numeral). One end of the rod 110 is sleeved in the sleeve 120 and received in the accommodating space. The sleeve 120 can be displaced along its axial direction X (see FIG. 6) relative to the rod 110.

As shown in FIG. 2, the rod 110 has an outer surface that includes an accommodating slot 111, an engaging block 130, at least one elastic element 140, and a connecting portion 112. While FIG. 2 shows two elastic elements 140, the number of the at least one elastic element 140 is not limited to two. The engaging block 130 and the elastic elements 140 are disposed in the accommodating slot 111. Each elastic element 140 has one end pressing against a wall portion of the accommodating slot 111 and the opposite end pressing against the engaging block 130. The connecting portion 112 is adjacent to the accommodating slot 111 and surrounds the outer surface of the rod 110.

The engaging block 130 may include two protruding posts 131. The protruding posts 131 are respectively disposed at two opposite end faces 133 of the engaging block 130 and abut against wall portions 1111 of the accommodating slot 111 respectively. As shown in FIG. 6, the end of each protruding post 131 that abuts against the corresponding wall portion 1111 is shaped as a circular dome. The two protruding posts 131, therefore, serve as supporting points for the engaging block 130 to either allow the engaging block 130 to jut out from or retract into the accommodating slot 111 more smoothly, or allow the engaging block 130 to tilt at an angle with respect to the axial direction X so that the sleeve 120 can be moved more smoothly relative to the rod 110. In the embodiment shown in FIG. 2, the engaging block 130 has a fan-shaped cross section and a curved surface and includes a plurality of ratchet teeth 132. The ratchet teeth 132 are disposed on the curved surface of the engaging block 130.

As shown in FIG. 3, the inner surface of the sleeve 120 includes a first ratchet portion 121, a second ratchet portion 122, and a non-ratchet portion 123. The non-ratchet portion 123 is located between the first ratchet portion 121 and the second ratchet portion 122. The axial length of the second ratchet portion 122 may be equal to the axial length of the non-ratchet portion 123, and the axial length of the first ratchet portion 121 may be greater than the axial length of the second ratchet portion 122 and the axial length of the non-ratchet portion 123. Moreover, the axial length of the engaging block 130 may be greater than the axial length of the connecting portion 112, the axial length of the engaging block 130 of the rod 110 may be equal to the axial length of the first ratchet portion 121, and the axial length of the connecting portion 112 may be equal to the axial length of the second ratchet portion 122 and the axial length of the non-ratchet portion 123. The foregoing dimensional relationships not only allow the rod 110 and the sleeve 120 to be positioned more securely relative to each other, but also make it possible to operate the wrench structure 100 with a variable driving state more smoothly. It should be pointed out that the axial lengths stated above refer to the lengths of the first ratchet portion 121, of the second ratchet portion 122, of the non-ratchet portion 123, of the engaging block 130, and of the connecting portion 112 that are parallel to the axial direction X of the sleeve 120. In addition, the sleeve 120 may further include at least one decorative groove 126. While FIG. 3 shows two decorative grooves 126, the number of the at least one decorative groove 126 is not limited to two. The decorative grooves 126 are disposed in the outer surface of the sleeve 120 to render the outer surface of the sleeve 120 uneven, thereby allowing a user to better hold the sleeve 120 and operate the sleeve 120 more smoothly.

Figure 5:
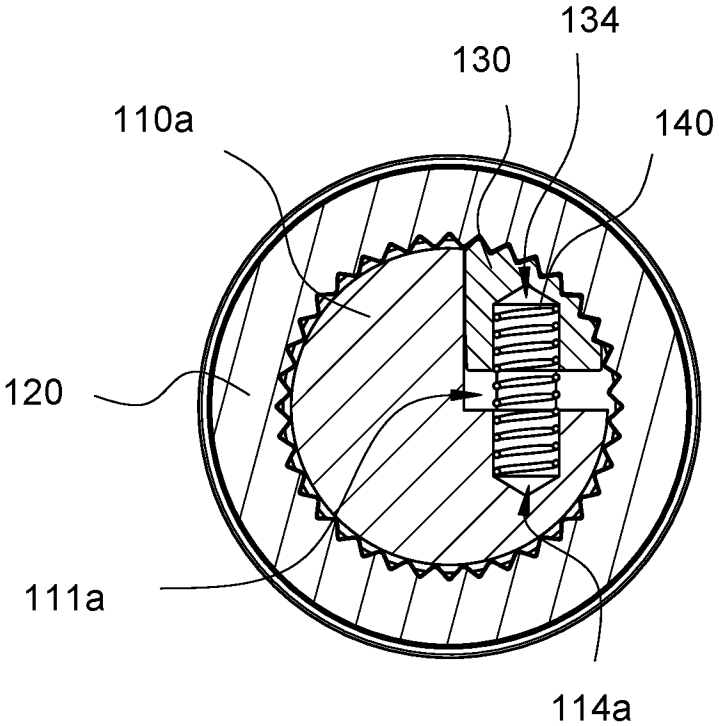
FIG. 5 is a sectional view, taken along line 4-4 in FIG. 1, of the wrench structure with a variable driving state according to another embodiment of the invention.
Figure 4:
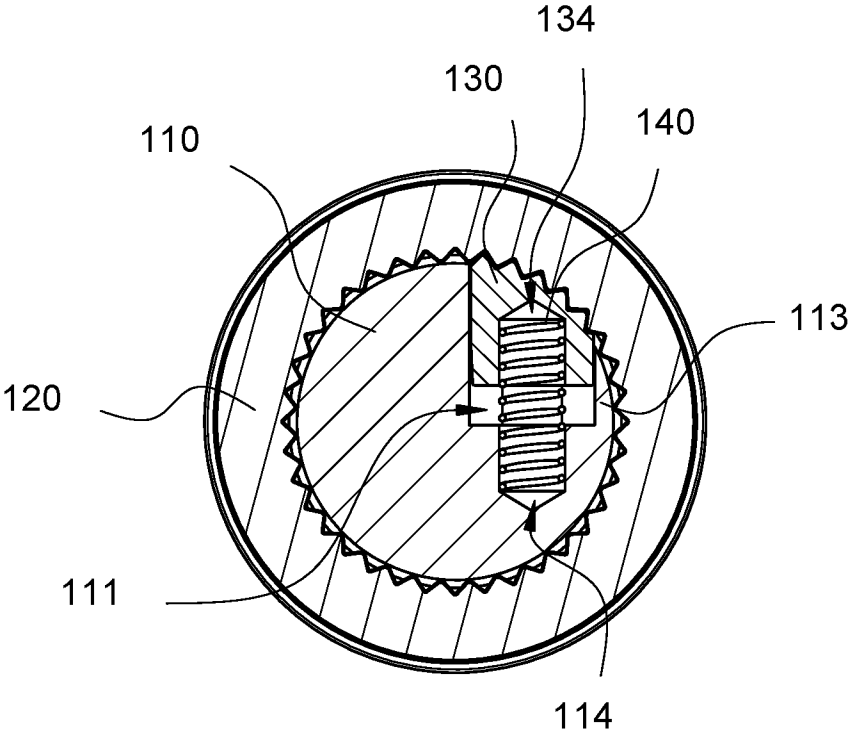
FIG. 4 is a sectional view, taken along line 4-4 in FIG. 1, of the wrench structure with a variable driving state according to the embodiment in FIG. 1.

Please refer to FIG. 4 and FIG. 5 respectively for a sectional view, taken along line 4-4 in FIG. 1, of the wrench structure 100 with a variable driving state according to the embodiment in FIG. 1 and a sectional view, taken along line 4-4 in FIG. 1, of the wrench structure 100 with a variable driving state according to another embodiment of the present invention. When the sleeve 120 and the rod 110 are put together and are at the first position, the ratchet teeth 132 on the curved surface of the engaging block 130 are engaged with the first ratchet portion 121 of the sleeve 120. The rod 110 may further include an enclosing portion 113 as shown in FIG. 4 such that the cross section of the accommodating slot 111 of the rod 110 is rendered into a square U shape to allow the engaging block 130 to be connected more securely in the accommodating slot 111. Alternatively, as shown in FIG. 5, the accommodating slot 111*a* of the rod 110*a* may have an L-shaped cross section. The cross-sectional shape of the accommodating slot, however, is not limited to those disclosed herein. The cross-sectional shape of the accommodating slot 111 of the rod 110 can be designed according to user needs, in order to provide different options regarding the area and extent of contact between the engaging block 130 and the first ratchet portion 121.

Figure 8:
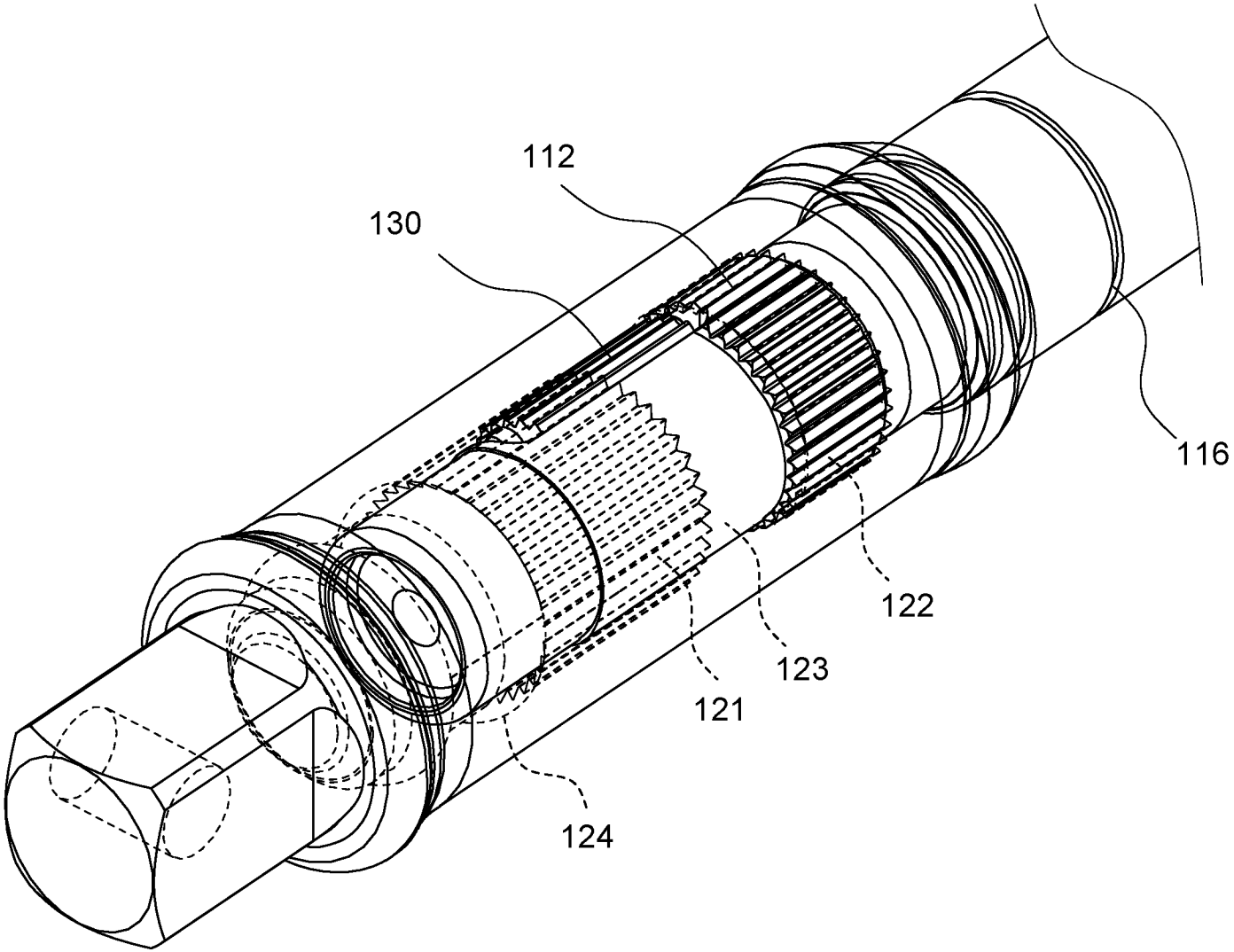
FIG. 8 is a partial see-through view of the wrench structure with a variable driving state according to the embodiment in FIG. 1.
Figure 9:
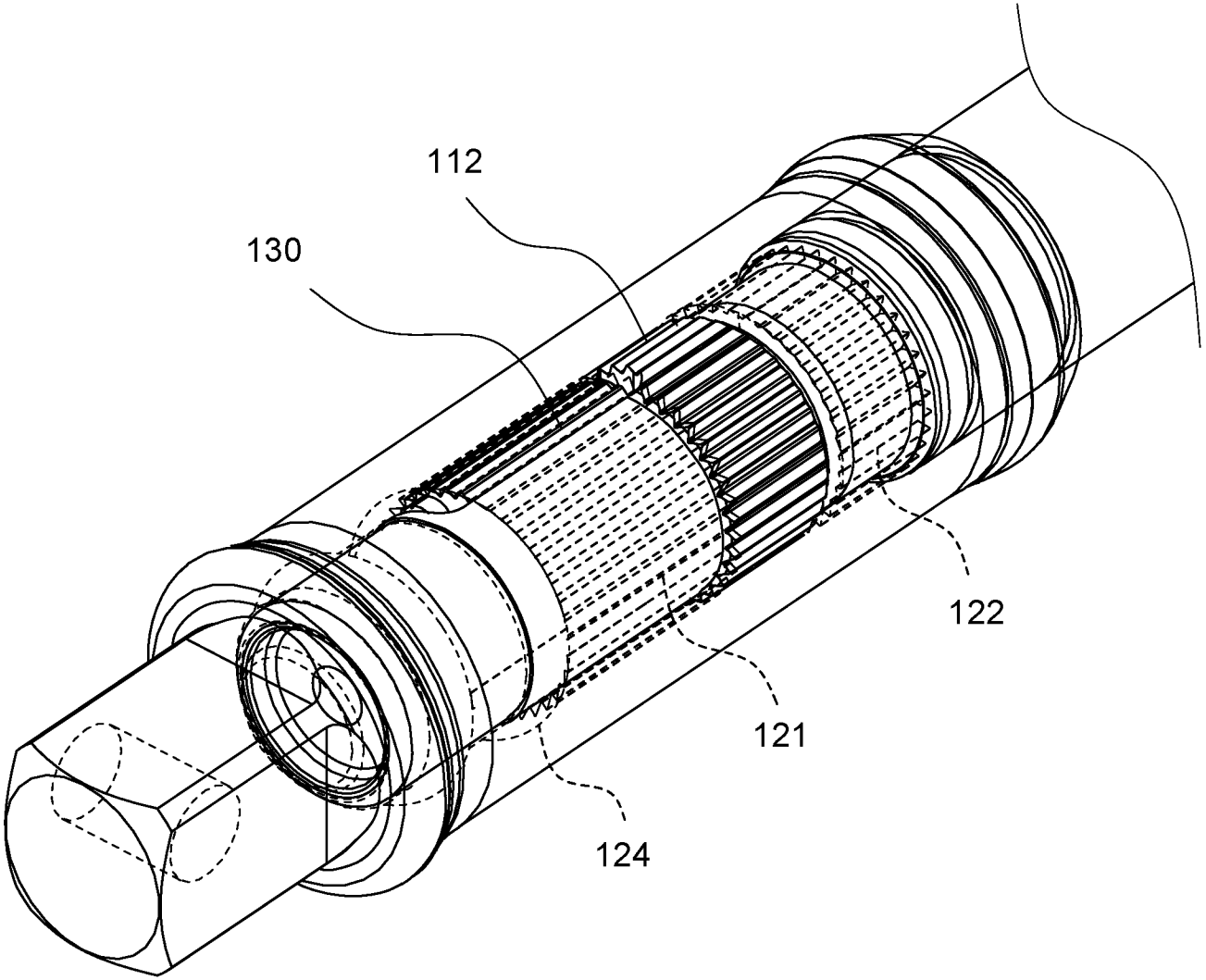
FIG. 9 is another partial see-through view of the wrench structure with a variable driving state according to the embodiment in FIG. 1.

Please refer to FIG. 6 and FIG. 7 respectively for a sectional view, taken along line 6-6 in FIG. 1, of the wrench structure 100 with a variable driving state according to the embodiment in FIG. 1 and another sectional view, taken along line 6-6 in FIG. 1, of the wrench structure 100 with a variable driving state according to the embodiment in FIG. 1. To have a better understanding of the present invention, please also refer to FIG. 8 and FIG. 9 respectively for a partial see-through view of the wrench structure 100 with a variable driving state according to the embodiment in FIG. 1 and another partial see-through view of the wrench structure 100 with a variable driving state according to the embodiment in FIG. 1. The sleeve 120 in FIG. 6 and FIG. 8 is at the first position relative to the rod 110 in order for the wrench structure 100 with a variable driving state to be used as a fixed-head wrench, and the sleeve 120 in FIG. 7 and FIG. 9 is at the second position relative to the rod 110 in order for the wrench structure 100 with a variable driving state to be used as a ratchet wrench.

As shown in FIG. 6, the wrench structure 100 with a variable driving state may include at least one installation groove. The at least one installation groove is formed in at least one of an inner surface of the rod 110 and another surface portion of the engaging block 130 so that the at least one elastic element 140 can be installed in the at least one installation groove. In the embodiment shown in FIG. 6, the wrench structure 100 with a variable driving state includes two first installation grooves 114 and two second installation grooves 134. The first installation grooves 114 are formed in the inner surface of the rod 110, and the second installation grooves 134 are formed in one side of the engaging block 130. Each elastic element 140 has one end pressing against a wall portion of the corresponding first installation groove 114 and the opposite end pressing against a wall portion of the corresponding second installation groove 134. Thus, the engaging block 130 is embedded in the rod 110 and can retractably jut out from the rod 110 in order to engage, and consequently move, with the sleeve 120. The provision of the first installation grooves 114 and the second installation grooves 134 also helps increase the stability of the connection between the elastic elements 140 and the rod 110 and between the elastic elements 140 and the engaging block 130.

As shown in FIG. 6, the sleeve 120 may further include at least two annular recesses 124, wherein the annular recesses 124 are disposed in the inner surface of the sleeve 120. The rod 110 may further include a receiving groove 118, a positioning ball 117, and a spring 119. The receiving groove 118 is formed in the outer surface of the rod 110. The positioning ball 117 and the spring 119 are received in the receiving groove 118. The spring 119 has one end pressing against the positioning ball 117 such that the positioning ball 117 juts out from the outer surface of the rod 110 in a retractable manner. The positioning ball 117 can be selectively connected with either one of the annular recesses 124. In the embodiment shown in FIG. 6, there is one positioning ball 117 and two annular recesses 124, and yet the number of the positioning ball and the number of the at least two annular recesses are not limited to those disclosed herein. The provision of the annular recesses 124, the receiving groove 118, the positioning ball 117, and the spring 119 not only allows the rod 110 and the sleeve 120 to be positioned more securely relative to each other, but also allows the wrench structure 100 with a variable driving state to be operated more stably.

The wrench structure 100 with a variable driving state may further include a C-shaped retaining ring 150 and an interference fit member 125. The C-shaped retaining ring 150 is disposed on the outer surface of the rod 110 and is configured to connect the sleeve 120 to the rod 110 and thereby prevent the sleeve 120 from falling off the rod 110. The interference fit member 125 is disposed on the inner surface of the sleeve 120 and protrudes from the inner surface of the sleeve 120. The interference fit member 125 presses against the outer surface of the rod 110 to increase not only the secureness of the connection between the sleeve 120 and the rod 110, but also the operational stability of the wrench structure 100 with a variable driving state.

When the sleeve 120 is at the first position relative to the rod 110 as shown in FIG. 6 and FIG. 8, the connecting portion 112 is connected with the second ratchet portion 122, and the engaging block 130 is engaged with the first ratchet portion 121; as a result, the sleeve 120 cannot be rotated relative to the rod 110. Hence, with the engaging block 130 completely engaged with the first ratchet portion 121, a user can apply a force to a to-be-locked object through the wrench structure 100 with a variable driving state. Moreover, with the connecting portion 112 and the engaging block 130 respectively engaged with the first ratchet portion 121 and the second ratchet portion 122, the sleeve 120 can evenly distribute the stress resulting from the force applied to the rod 110 by the user and is connected to the rod 110 even more securely so that the user can increase the force applied.

When the user wishes to switch the wrench structure 100 with a variable driving state from a fixed-head wrench to a ratchet wrench, referring to FIG. 7 and FIG. 9, the sleeve 120 is moved along its axial direction X from the first position to the second position relative to the rod 110 such that the connecting portion 112 is adjacent to the non-ratchet portion 123. The connecting portion 112 in this state is no longer engaged with the second ratchet portion 122, so the sleeve 120 can be rotated relative to the rod 110. Furthermore, the engaging block 130 in this state is connected with the first ratchet portion 121 so that when the user rotates the sleeve 120 in a predetermined direction, the first ratchet portion 121 will press against the engaging block 130 and thus push the elastic elements 140, thereby allowing the sleeve 120 to move relative to the rod 110 in the predetermined direction, and that when the sleeve 120 is rotated in the opposite direction, the sleeve 120 and the rod 110 will move together in an engaged state. In other words, the sleeve 120, when at the second position, can be moved in a reciprocating manner but will move together with the rod 110 in one direction only. Thus, the wrench structure 100 with a variable driving state functions as a one-way ratchet wrench.

It is worth mentioning that, referring to FIG. 2 and FIG. 3, both the ratchet teeth 132 of the engaging block 130 and the ratchet teeth (not denoted by a reference numeral) of the second ratchet portion 122 extend in the axial direction X. This coaxial arrangement helps increase not only the area of contact, but also the engaging force, between the engaging block 130 and the second ratchet portion 122. When the wrench structure 100 with a variable driving state is in use, therefore, the coaxial arrangement ensures a sufficient engaging force and keeps the rod 110 or the sleeve 120 from deformation, thereby extending the service life of the wrench structure 100 with a variable driving state.

In order for a user to more clearly identify the current driving state of the wrench structure 100 with a variable driving state, referring to FIG. 2, FIG. 6, and FIG. 7, the rod 110 may further include a first identification groove 115 and a second identification groove 116. The first identification groove 115 and the second identification groove 116 are disposed in the outer surface of the rod 110, and the second identification groove 116 is located farther away from the connecting portion 112 than is the first identification groove 115. When the sleeve 120 is at the first position relative to the rod 110, as shown in FIG. 6, both the first identification groove 115 and the second identification groove 116 are exposed. When the sleeve 120 is at the second position relative to the rod 110, as shown in FIG. 7, the first identification groove 115 is covered by the sleeve 120 and is therefore not exposed; only the second identification groove 116 is exposed to view. Thus, the current driving state of the wrench structure 100 with a variable driving state can be known by checking if the first identification groove 115 is visible on the rod 110. The color of the first identification groove 115 may be different from the color of the second identification groove 116 so that a user can more rapidly and more intuitively identify the current driving state of the wrench structure 100 with a variable driving state.

According to the above, the wrench structure with a variable driving state of the present invention can be swiftly switched between a fixed-head wrench and a ratchet wrench through a simple operation and thus provide both a relatively high output torque and a one-way ratcheting function to allow more flexible and more convenient operation than the prior art.

While the present invention has been disclosed through the embodiments described above, those embodiments are not intended to be restrictive of the invention. A person skilled in the art can change or modify the embodiments in various ways without departing from the concept or scope of the invention. The scope of the patent protection sought by the applicant is defined by the appended claims.

What is claimed is:

1. A wrench structure with a variable driving state, comprising:

a rod, the rod having an outer surface comprising:

an accommodating slot;

an engaging block disposed in the accommodating slot, wherein the engaging block has a surface portion formed as a curved surface and comprises a plurality of ratchet teeth, and the ratchet teeth are disposed on the curved surface of the engaging block;

at least one elastic element, wherein the at least one elastic element has one end pressing against a wall portion of the accommodating slot and an opposite end pressing against the engaging block; and a connecting portion adjacent to the accommodating slot and surrounding the outer surface of the rod; and a sleeve connected to the rod, the sleeve having an inner surface comprising:

a first ratchet portion;

a second ratchet portion; and a non-ratchet portion located between the first ratchet portion and the second ratchet portion;

wherein the sleeve is selectively displaceable relative to the rod to a first position or a second position, the connecting portion is connected with the second ratchet portion when the sleeve is at the first position, and the connecting portion is adjacent to the non-ratchet portion when the sleeve is at the second position.

2. The wrench structure with a variable driving state as claimed in claim 1, wherein the engaging block has a greater axial length than the connecting portion.

3. The wrench structure with a variable driving state as claimed in claim 1, wherein the engaging block comprises two protruding posts, and the protruding posts are disposed at two ends of the engaging block respectively and abut against two other wall portions of the accommodating slot respectively.

4. The wrench structure with a variable driving state as claimed in claim 1, wherein the rod further comprises an enclosing portion, and the enclosing portion is connected to the accommodating slot and renders a cross section of the accommodating slot into a square U shape.

5. The wrench structure with a variable driving state as claimed in claim 1, wherein the engaging block has a fan-shaped cross section.

6. The wrench structure with a variable driving state as claimed in claim 1, further comprising at least one installation groove, wherein the at least one installation groove is formed in at least one of the accommodating slot of the rod and another surface portion of the engaging block, and the at least one elastic element is installed in the at least one installation groove.

7. The wrench structure with a variable driving state as claimed in claim 1, wherein the rod further comprises:

a first identification groove disposed in the outer surface of the rod; and a second identification groove disposed in the outer surface of the rod and located farther away from the connecting portion than is the first identification groove.

8. The wrench structure with a variable driving state as claimed in claim 1, wherein the sleeve further comprises at least two annular recesses disposed in the inner surface of the sleeve, and the rod further comprises:

a receiving groove formed in the outer surface of the rod;

a positioning ball received in the receiving groove; and a spring received in the receiving groove, wherein the spring has one end pressing against the positioning ball such that the positioning ball juts out from the outer surface of the rod in a retractable manner, and the positioning ball is selectively connectable with either one of the annular recesses.

9. The wrench structure with a variable driving state as claimed in claim 1, further comprising:

a C-shaped retaining ring disposed on the outer surface of the rod and configured to connect the sleeve to the rod; and an interference fit member disposed on and protruding from the inner surface of the sleeve, wherein the interference fit member presses against the outer surface of the rod.

* * * * *